US011141625B2

(12) United States Patent
McAllister

(10) Patent No.: US 11,141,625 B2
(45) Date of Patent: Oct. 12, 2021

(54) STEERING ASSEMBLY FOR A MOUNTED BICYCLE

(71) Applicant: Daniel J. McAllister, Woodstock, GA (US)

(72) Inventor: Daniel J. McAllister, Woodstock, GA (US)

( * ) Notice: Subject to any disclaimer, the term of this patent is extended or adjusted under 35 U.S.C. 154(b) by 0 days.

(21) Appl. No.: 16/892,836

(22) Filed: Jun. 4, 2020

(65) Prior Publication Data

US 2021/0228939 A1 Jul. 29, 2021

Related U.S. Application Data

(60) Provisional application No. 62/965,350, filed on Jan. 24, 2020.

(51) Int. Cl.
*A63B 22/06* (2006.01)
*A63B 69/16* (2006.01)

(52) U.S. Cl.
CPC ..... *A63B 22/0605* (2013.01); *A63B 69/16* (2013.01); *A63B 2022/0641* (2013.01); *A63B 2069/162* (2013.01); *A63B 2069/163* (2013.01); *A63B 2069/164* (2013.01); *A63B 2225/093* (2013.01)

(58) Field of Classification Search
CPC ..... A63B 69/16–2069/168; A63B 2022/0641; B62H 1/12; B62H 7/00
See application file for complete search history.

(56) References Cited

U.S. PATENT DOCUMENTS 6,126,571 A 10/2000 Parks
7,083,551 B1 8/2006 Lassanske et al.
7,226,395 B2 6/2007 Wu et al.
(Continued)

FOREIGN PATENT DOCUMENTS

EP 1214957 A1 6/2002
EP 1754520 A1 2/2007
(Continued)

OTHER PUBLICATIONS

Schlange, Eric, "Setting Up Your Front Wheel and Phone for Zwift Steering" | Zwift Insider | dated Oct. 2, 2019 | website located at: https://zwiftinsider.com/setting-up-your-bike-and-phone-for-swift-steering/ | 9 pages, printed on Jan. 29, 2020.
(Continued)

*Primary Examiner* — Jennifer Robertson
(74) *Attorney, Agent, or Firm* — Hanrahan Law Firm, P.A.; Benjamin M. Hanrahan

(57) ABSTRACT

A steering assembly for a mounted bicycle is disclosed herein. The steering assembly includes a support base and at least one omnidirectional roller assembly extending from a bottom surface thereof. The at least one omnidirectional roller assembly is operatively disposed in direct contact with a ground surface and is structured to facilitate movement of the support base along the ground surface in a plurality of different arcuate and linear paths to accommodate varying
(Continued)

trail measurements of a bicycle. The varying trail measurements of the bicycle are defined by varying angles of the bicycle relative to the ground surface during operative use of the steering assembly.

18 Claims, 16 Drawing Sheets

(56) References Cited

U.S. PATENT DOCUMENTS

| | | | | |
|---|---|---|---|---|
| 7,682,286 | B2 * | 3/2010 | Badarneh | A63B 26/003 482/5 |
| 7,736,282 | B1 | 6/2010 | Horowitz | |
| 7,963,889 | B2 | 6/2011 | Badarneh et al. | |
| 2002/0055422 | A1 * | 5/2002 | Airmet | A63F 13/06 482/61 |
| 2007/0010377 | A1 * | 1/2007 | Wu | A63B 69/16 482/61 |
| 2007/0049467 | A1 * | 3/2007 | Lin | A63B 26/003 482/57 |
| 2007/0105694 | A1 | 5/2007 | Panatta | |
| 2008/0269025 | A1 | 10/2008 | Badarneh et al. | |
| 2009/0283648 | A1 * | 11/2009 | Chiang | A63B 69/16 248/187.1 |
| 2011/0136630 | A1 | 6/2011 | Zwinkels | |
| 2018/0257723 | A1 * | 9/2018 | Roberto, Jr. | B62H 1/12 |
| 2018/0369675 | A1 | 12/2018 | Papadopoulos | |

FOREIGN PATENT DOCUMENTS

| | | | |
|---|---|---|---|
| EP | 2181741 | A1 | 5/2010 |
| KR | 101937243 | B1 | 1/2019 |
| NL | 2006702 | C2 | 11/2012 |
| WO | 2005046806 | A3 | 9/2005 |

OTHER PUBLICATIONS

Reddit.com | "My Zwift Steering Build" | dated Oct. 2019 | website located at: https://www.reddit.com/r/Zwift/comments/deaa0r/my_zwift_steering_build/ | 26 pages | pp. 1-16, printed on Jan. 29, 2020, pp. 17-26, printed on Jul. 17, 2021.

PCT International Search Report, for Patent Cooperation Treaty (PCT) Application No. PCT/US2021/014810, filed Jan. 23, 2018, dated Apr. 23, 2021.

Written Opinion of the International Searching Authority, for Patent Cooperation Treaty (PCT) Application No. PCT/US2021/014810, filed Jan. 23, 2021, dated Apr. 23, 2021.

* cited by examiner

STEERING ASSEMBLY FOR A MOUNTED BICYCLE

CLAIM OF PRIORITY/CROSS-REFERENCE TO RELATED APPLICATION

The present application is based on and a claim of priority is made under 35 U.S.C. § 119(e) to provisional patent application Ser. No. 62/965,350, filed on Jan. 24, 2020, the contents of which are incorporated herein in their entirety by reference.

FIELD OF THE INVENTION

The present invention is generally directed to a steering assembly, which in some cases includes a base, plate or platform for use in connection with a mounted bicycle and/or a bicycle training assembly or gaming system. More specifically, the steering base allows the front wheel or front steering components (e.g., handlebars and front fork) of a mounted bicycle to be turned or rotated during use, and which can accommodate for trail, which in some cases can be constantly or continuously changing during operation of the mounted bicycle, training assembly or game system.

BACKGROUND OF THE INVENTION

Stationary cycling is a low-impact or in some cases no-impact workout that has been around for many years. Historically, stationary cycling involves the use of a complete, stand-alone special-purpose exercise machine that resembles a bicycle, but does not have functional wheels that an ordinary bicycle would have. Instead, the exercise machine, often referred to as a "spin bike," may include a saddle or seat, pedals, and a form of handlebars arranged such that the exerciser is seated in a position similar to that of an ordinary bicycle rider. In some cases, weighted or magnetic resistance mechanisms are built into the exercise machine.

In other instances, an ordinary bicycle can be adapted to function as a stationary bicycle by mounting or securing the bicycle to a fixture such as, but not limited to, a bicycle roller, stand or "trainer." Bicycle trainers are often referred to as devices to which the rear portion of the bicycle (e.g., the rear wheel, rear hub, rear portion of the frame, rear frame forks, etc.) mounts and in some cases can provide resistance to the bicycle during use. In this manner, rollers, stands or trainers can be used by cyclists to warm up before a race or by virtually any user or exerciser in his or her own home to convert an ordinary or operable bicycle into a stationary mounted bicycle or exercise machine. In some cases, the rear wheel of an ordinary or operable bicycle may be removed in order to attach or mount the bicycle (e.g., at the rear hubs) to the stand or trainer. Accordingly, some rollers, stands and/or trainers allow the rider or user to pedal an ordinary bicycle (sometimes, but not always, with the rear wheel removed) to feel resistance based on the internal settings of the trainer or other fixture.

Riding a bicycle on a trainer or other like fixture historically is often described as a miserable, painful, lonely, and mind-numbing experience. That, however, has rapidly changed in recent years. As an example, some trainer manufacturers have developed "Smart Trainers," which are trainers that can be connected to an application or device, either wirelessly or wired, that can control the resistance applied to the rear wheel or pedals of the bicycle. The application or device can then provide workout simulations of various types to help the rider achieve various or desired fitness goals. Although a potential improvement, the "Smart Trainers" are still described as being boring or mind-numbing, since the rider will often be staring at a blank wall or in some cases, trying to pass time by watching television or other unrelated multimedia broadcast.

Recently however, advances in technology have made stationary cycling much more engaging and interactive. For instance, using the Internet or other network, riders and users can interact with an instructor, and pit themselves against other people from around the World. In addition, there is at least one known virtual reality cycling system—ZWIFT®—which is an Internet-based subscriber-paid virtual reality game. More in particular, a user is able to connect his or her smart trainer to the ZWIFT® game or system to participate in a realistic, engaging and more enjoyable experience while riding indoors. The ZWIFT® game has real three-dimensionally GPS mapped courses of a number of real cities on Earth, and at least one fictitious island known as "Watopia" in the Pacific Ocean. The graphics are compelling and an online community of at least 1.1 million subscribers exists at this filing.

Furthermore, the ZWIFT® game requires the rider to physically engage in a similar manner as her or she would have to while riding in the "real world," with two exceptions—1. there are no brakes implemented in the ZWIFT® game, and 2. the user does not steer the bicycle.

In December of 2019, ZWIFT® released the first crude versions of a "steering course" for virtual mountain bike use. With the advent of a rider-steered course in a stationary environment came the need for a device that has not yet existed, and had not yet been imagined.

It should be noted that virtually all "steered" vehicles or devices, such a bicycles, have some form of self-aligning and stabilizing geometry to the steering system known as "trail." Trail is defined as the horizontal distance the contact patch of a steered wheel falls behind an imaginary line drawn through the steering axis to the ground. In other words, trail is defined as the distance where the steered wheel (e.g., the front wheel on a bicycle) touches the ground to where the steering axis intersects the ground. The steering axis is a straight-lined axis drawn through the steering tube of the bicycle to intersect the ground at a head angle. The trail of a standard bicycle with both wheels on the ground can be increased by increasing the front wheel size, increasing the head angle, or decreasing the fork offset. Similarly, trail of a standard bicycle with both wheels on the ground can be decreased by decreasing the head angle, increasing the fork offset, or decreasing the front wheel diameter.

As an example, a shopping cart caster wheel works due to the trail. For instance, regardless of which direction the wheel is pointed, when the cart is pushed forward, the caster wheel will automatically spin around to the rear and align itself in the direction of travel. This is because of the trail incorporated into the caster wheel.

Bicycles also incorporate trail into the design, which helps with stabilization and steering of the bicycle during use or operation. Without trail, the bicycle would wobble, shake violently, and most likely throw the rider off.

Trail is virtually imperceptible to the rider in a normal outdoor environment where the bicycle is free to roll or travel down the road. However, in a stationary cycling environment, where the rear of the bicycle is generally fixed or mounted to a device (e.g., a stand) to hold it locked in place, the steering system is rendered dysfunctional.

For example, while it is often perceived that the front wheel of a bicycle turns on the contact patch of the tire, as explained by trail, it is not. There is a "lever" following behind the true steering pivot. In order for the front wheel to turn in this environment, it must be free to move on the ground in the form of an arc, which it clearly cannot do. For reference, the arc would appear as a "Smile" or a "U" when viewed from the handlebars looking down at the front wheel.

If a rider were to try and force the front wheel to turn on the ground, the front fork and suspension (if so equipped, i.e. mountain bike) will be forced to twist resulting in possible damage. Once the parts have been twisted to the point that they can overcome the rubber of the tire holding the wheel to the ground, the tire will then begin to slide on the ground in the prescribed arc. Dragging the tire on the ground will damage both the tire and the floor in use by the Rider.

Reversing the steering and trying to find "straight" is the next problem. It will require a secondary resistance and fight from the bicycle against the rider's wishes.

The problem becomes amplified in the realm of virtual cycling when the trail of the stationary or mounted bicycle varies during use. For example, in some instances, the front portion of the bicycle can be mounted to front mounting device, which can, but does not necessarily need to allow for an adjustment or change in the gradient of the bicycle by raising and lowering the front end of the mounted bicycle. Accordingly, as used herein, the terms "elevator" or "gradient adjustment device" refers to a device or assembly on which the front of the bicycle is attached and which can be used to adjust or change the height of the front end of the bicycle, and therefore, the gradient or angle of the mounted bicycle relative to the ground or support surface. It should be noted that, in some cases, the front wheel of the mounted bicycle is removed and the front forks of the bicycle are secured to the elevator, gradient adjustment device or other front end mounting device. In other cases, the front wheel may remain on the mounted bicycle while the mounted bicycle or wheel is attached or secured to elevator or other device.

In any event, the elevator or other like gradient adjustment device is designed to raise and lower the front end of the bicycle as the virtual game or system moves through the three-dimensional maps or courses. Raising the front end of the mounted bicycle from its normal, level orientation (while maintaining the rear end of the bicycle substantially in place) is designed to simulate the rider traveling uphill or up a slope; whereas lowering the front end of the bicycle from its normal, level orientation (while maintaining the rear end of the bicycle substantially in place) is designed to simulate the rider travelling downhill, or down a slope.

Presently, there is one such company with an elevator device or gradient adjustment device—WAHOO FITNESS® has a device called the KICKR® Climb, which can simulate gradients from 0 to +20% by raising the front of the bicycle, and gradients from 0 to −10% by lowering the front of the bicycle.

Ordinary bicycles typically have around 2 to 2.5 inches of trail when ridden down the road. However, when the front end of the bicycle is raised, for example, by an elevator device, while the rear end of the bicycle remains in the same or generally the same position or orientation, for instance, when the rear wheel or rear of the bicycle is mounted to a fixture, the trail is dramatically increased. Similarly, when the front end of the bicycle is lowered, for example, by an elevator device, while the rear end of the bicycle remains in the same or generally the same position or orientation, the trail is dramatically decreased.

For instance, if the steering axis angle (e.g., the angle between the steering axis and a vertical plane extending from the center of the front hub to the ground) is decreased, the trail is also decreased. Similarly, if the front end of the bicycle is lowered, the trail also decreases. Alternatively, lifting or raising the front end of the bicycle and/or increasing the steering axis angle increases the trail, usually in a significant manner.

As an example, a bicycle mounted to or on an elevator device that raises the front end of the bicycle to a gradient of +15% can have as much as 10 inches of trail (which may be an increase of about 8 inches of trail). Attempting to turn the handlebars (with force) at such an angle with such a high trail, will cause the entire assembly, e.g., the elevator device and the mounted bicycle, to tip over and possibly injure or kill the rider. Accordingly, this makes it impossible for any rider to experience a steering environment using an elevator or other gradient adjustment device as presently constructed.

Further, as the front of the bicycle is lowered, the front wheel will come closer to the rear wheel reducing the wheelbase. The converse is also true. Raising the front of the bike will increase the wheelbase of the bike. A mechanism must be made to compensate for this movement, which again can be several inches.

Since many virtual courses will be dedicated to bicycles with suspension systems on them like mountain bikes have, these also require a forward and backward moving component. Compressing the suspension system while pedaling or bouncing on the pedals (with force) will cause the wheelbase to shorten. When the suspension extends, the wheelbase will get longer. This must be compensated for.

Further adding to the complexity required for a cycle training experience is a new device called a "Rocker Plate". A rocker plate is a device that the trainer, and sometimes even the entire bike, is placed on. The rocker plate will allow the bicycle to rock or toggle from side to side in order to simulate the actual rocking action of a bicycle going down the road, which greatly reduces saddle pain and fatigue for the cyclist.

Accordingly, there is a need in the art for a base or platform that can accommodate for this drastic change in trail during operation of the front end mounting device. A "lazy susan" type of device that simply rotates about a single vertical axis will not function properly with the trail varying during operation. As such, the proposed device or assembly of the present invention is configured to move in an omnidirectional manner and support movement along the ground surface in a plurality of different arcuate paths, as well as a plurality of linear paths.

SUMMARY OF THE INVENTION

Accordingly, at least one embodiment of the present invention is directed to a base or plate which can support a bicycle or a front end mounting device (including but not limited to an elevator or gradient adjustment device) upon the ground or other surface, and which is configured to move omnidirectionally in order to accommodate for the change or varying amount of trail that may be present during operation. For example, as the front end mounting device, e.g., an elevator or other gradient adjustment device, raises and lowers the front end of the mounted bicycle to simulate hills, slopes, etc., the base or plate of the present invention is capable of traveling and supporting the bicycle or front end mounting device as it moves in an omnidirectional manner upon the ground. In other words, the proposed base or plate may be capable to support movement along the ground surface in a plurality of different arcuate paths, as well as a plurality of linear paths.

Thus, as the front end of the bicycle is raised and lowered, the base or plate can move forward and backward upon the ground in general linear movements. With the front of the bicycle raised above its normal operating angle, pivoting or turning of the handle bars or steering tube will create a different (larger) arcuate path along the ground than when the front of the bicycle is at its normal operating angle. Similarly, with the front of the bicycle lowered below its normal operating angle, pivoting or turning the handle bars or steering tube will cause a different (smaller) arcuate path along the ground than when the front of the bicycle is at its normal operating angle. In this manner, at least one embodiment of the present invention is capable of accommodating these different arcuate and linear movements along the ground, and thus, the base or plate may be said to move omnidirectionally.

It should also be noted that the base of at least one embodiment may be integral with or built into an elevator device or other front end mounting device, while in other embodiments, a separate base, plate or platform may be used which can support or retain the bottom of the front end mounting device, for example, in an adjustable shoe. In other words, the omnidirectional rollers described herein can be integral with the bottom of the front end mounting device or built into a separate device or platform as described herein.

For example, in at least one embodiment, the present invention includes a platform or plate that defines a top and a bottom surface. In one example, the platform or plate may be approximately sixteen inches wide and sixteen inches long, however, other dimensions are contemplated within the full spirit and scope of the present invention.

Affixed to or extending from the bottom surface of the base, plate or platform of at least one embodiment is at last one, but more practically, a plurality of omnidirectional roller assemblies. In some cases, the omnidirectional roller assembly/assemblies may be steel transfer ball bearings of which a roller or ball is mounted within a fixture that allows the roller to move omnidirectionally, or in other words, in all directions to accommodate the varying trail, differing arcs and linear movements described herein. The fixture is then secured or fixed to the base, plate or platform in a manner such that the roller(s) extend from the bottom surface and are able to contact the ground surface during use. It should also be noted that other bearings or rollers can be used in accordance with other embodiments in order to implement the present invention in the intended fashion.

In addition, at least one embodiment of the present invention may include a shoe or other support assembly disposed on or otherwise extending from the top surface of the base, plate or platform. The support assembly is structured to allow a front end mounting device, including but in no way limited to an elevator or gradient adjustment device, to be disposed upon the base. In other words, the bottom surface of the front end mounting device may be seated within the shoe of the present invention. In other embodiments, the bicycle may be mounted to or rested upon the base itself. For instance, the front wheel of the bicycle may be seated with the support assembly, or in other embodiments, the front forks of the bicycle may be attached to secure to the support assembly.

In some embodiments, the support assembly or shoe may be adjustable in at least one direction, for example, by including one or more adjustable stops. The one or more adjustable stops may be moved inward and outward to accommodate front end mounting devices or bicycles of different sizes and shapes. In some case, the shoe may leave a space on either side of the bicycle wheel or front end mounting device in order to allow the bicycle or front end mounting device to tilt forward and backward and/or rock from side to side during operation.

In some embodiments, base will have holes large enough for the transfer bearings to pass through from the top, while still having the roller ball on the ground. In other words, the height of the roller assembly relative to the base can be adjusted in some embodiments. In this fashion, the base, plate or platform can be assembled with the bearings on the bottom of the platform resulting in a "high" height to accommodate bicycles mounted onto a rocker plate, or it can be assembled with the bearings passing through from the top of the plate for a very low profile to suit bicycles that are situated on the ground.

Further a series of height shims attached to the plate where the tire or elevator will sit can be used to precisely level the bicycle for the most realistic feeling.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1A:
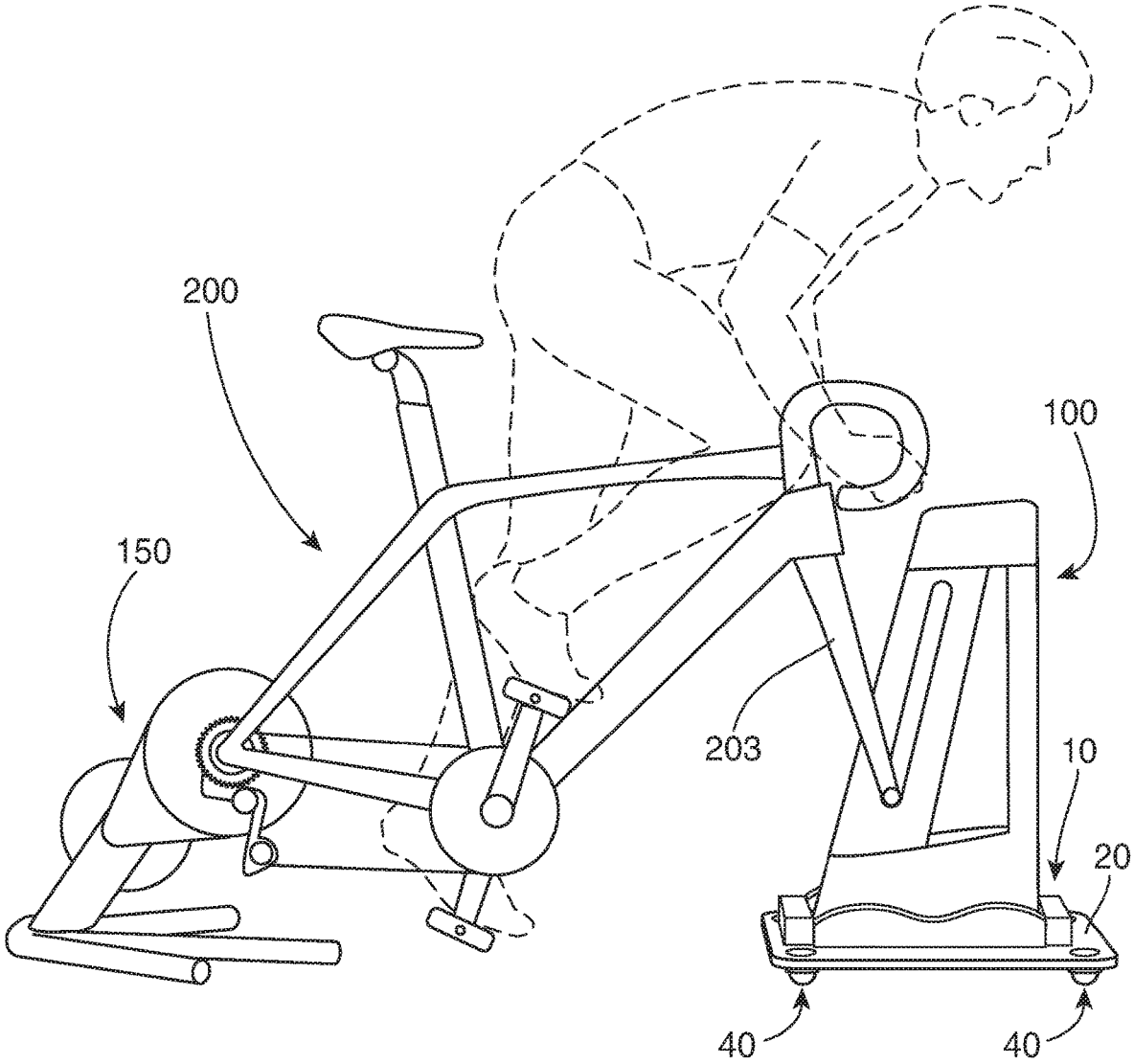
FIG. 1A is an exemplary illustration of a bicycle mounted to a gradient adjustment device supported by the steering assembly as disclosed in accordance with at least one embodiment of the present invention, the gradient adjustment device being disposed in a low position.
Figure 1B:
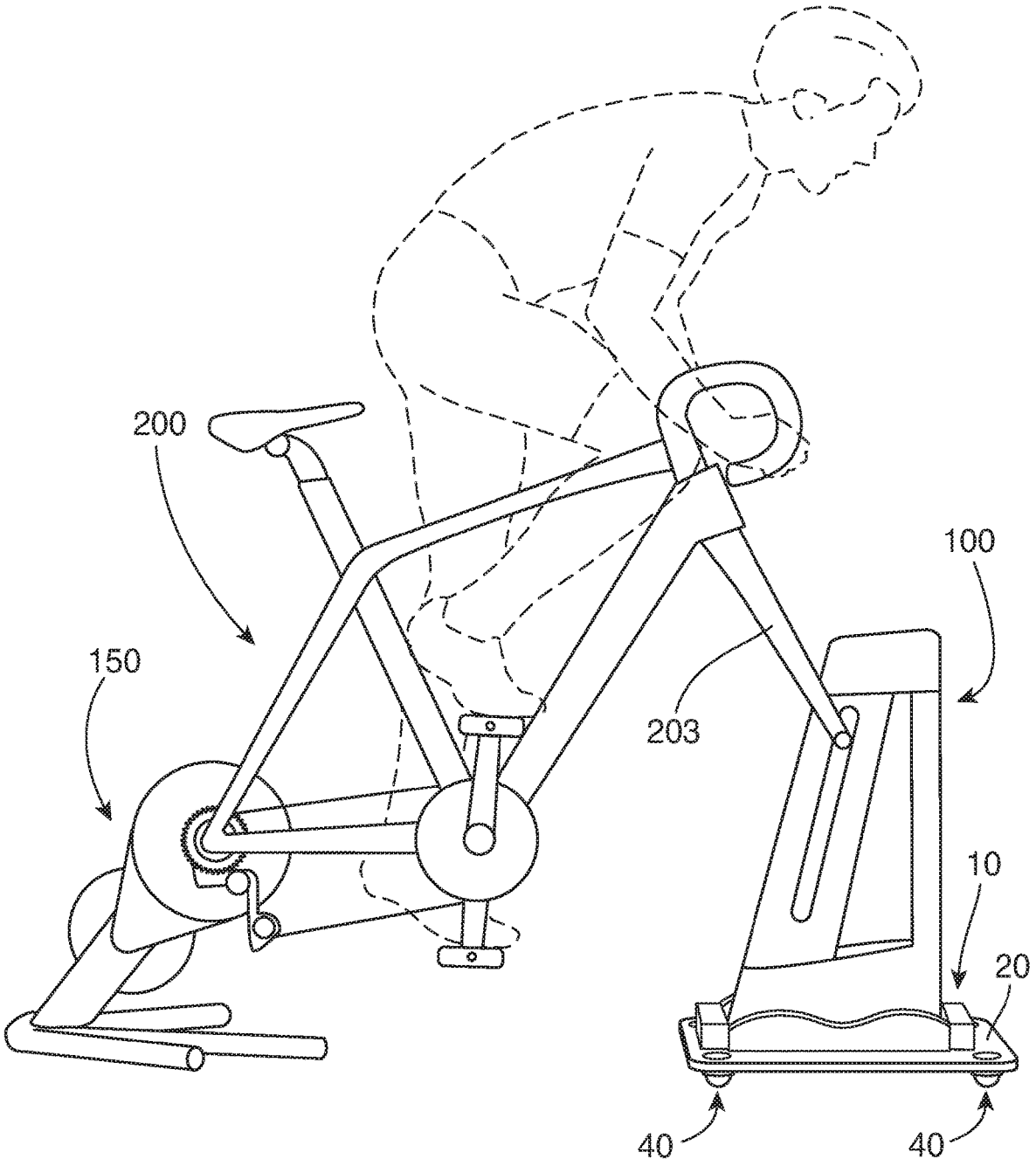
FIG. 1B is an exemplary illustration of a bicycle mounted to a gradient adjustment device supported by the steering assembly as disclosed in accordance with at least one embodiment of the present invention, the gradient adjustment device being disposed in a high position.
Figure 1C:
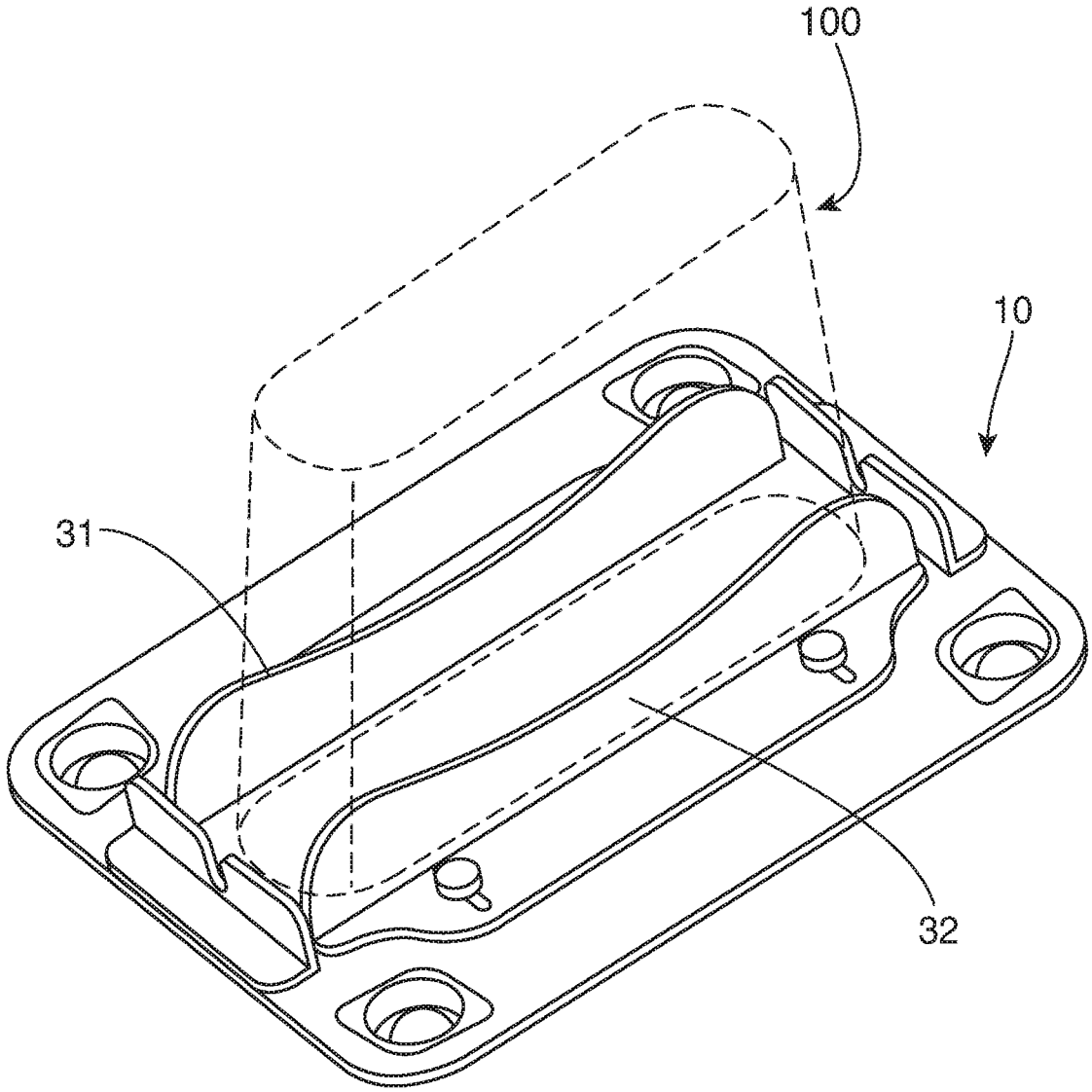
FIG. 1C is a close up view of the bottom portion of a gradient adjustment device being supported by the steering assembly as disclosed in accordance with at least one embodiment of the present invention.
Figure 2A:
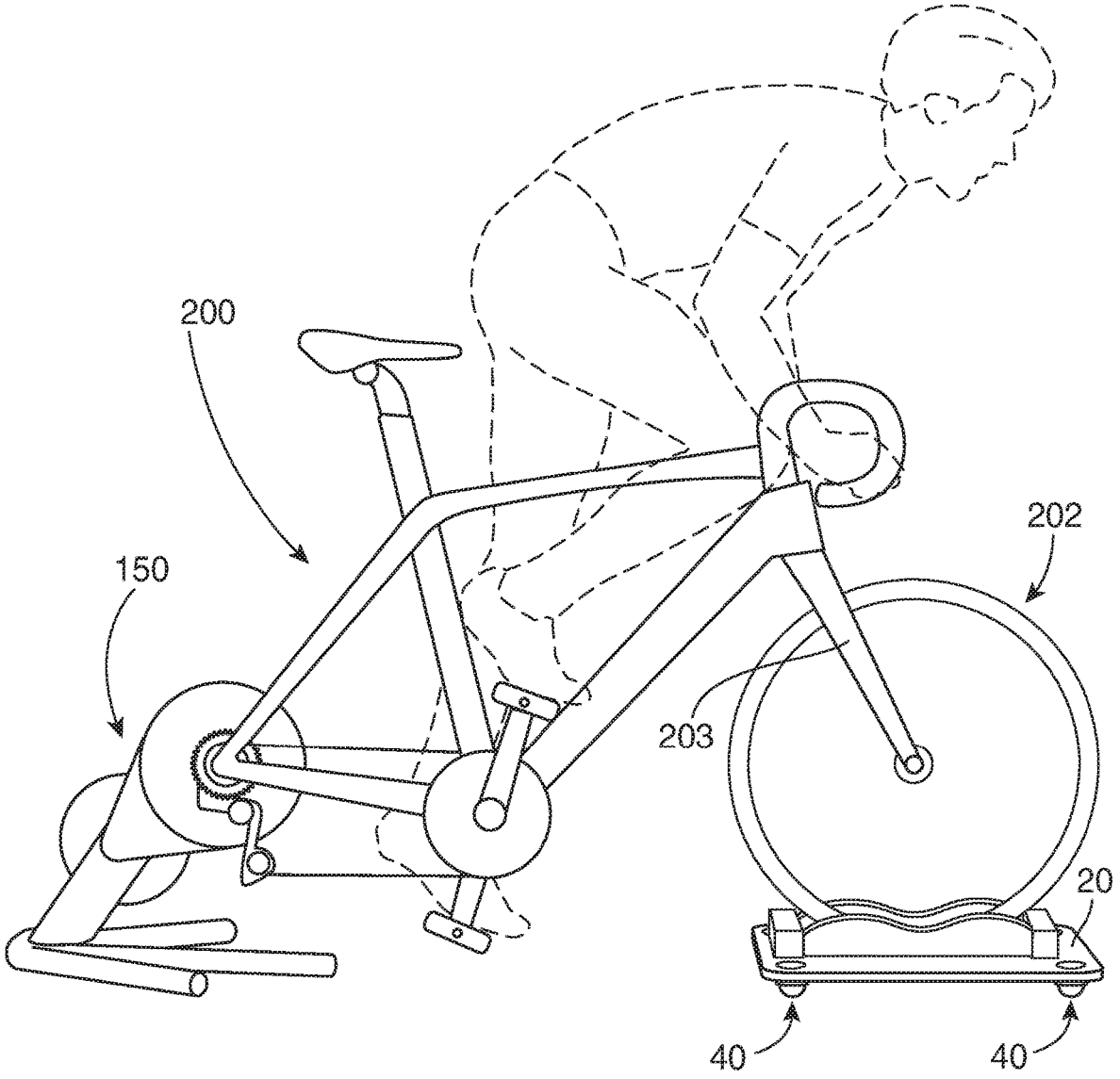
FIG. 2A is an exemplary illustration of the front wheel of a bicycle being support by the steering assembly as disclosed in accordance with at least one embodiment of the present invention, while the rear of the bicycle is mounted to a trainer.
Figure 2B:
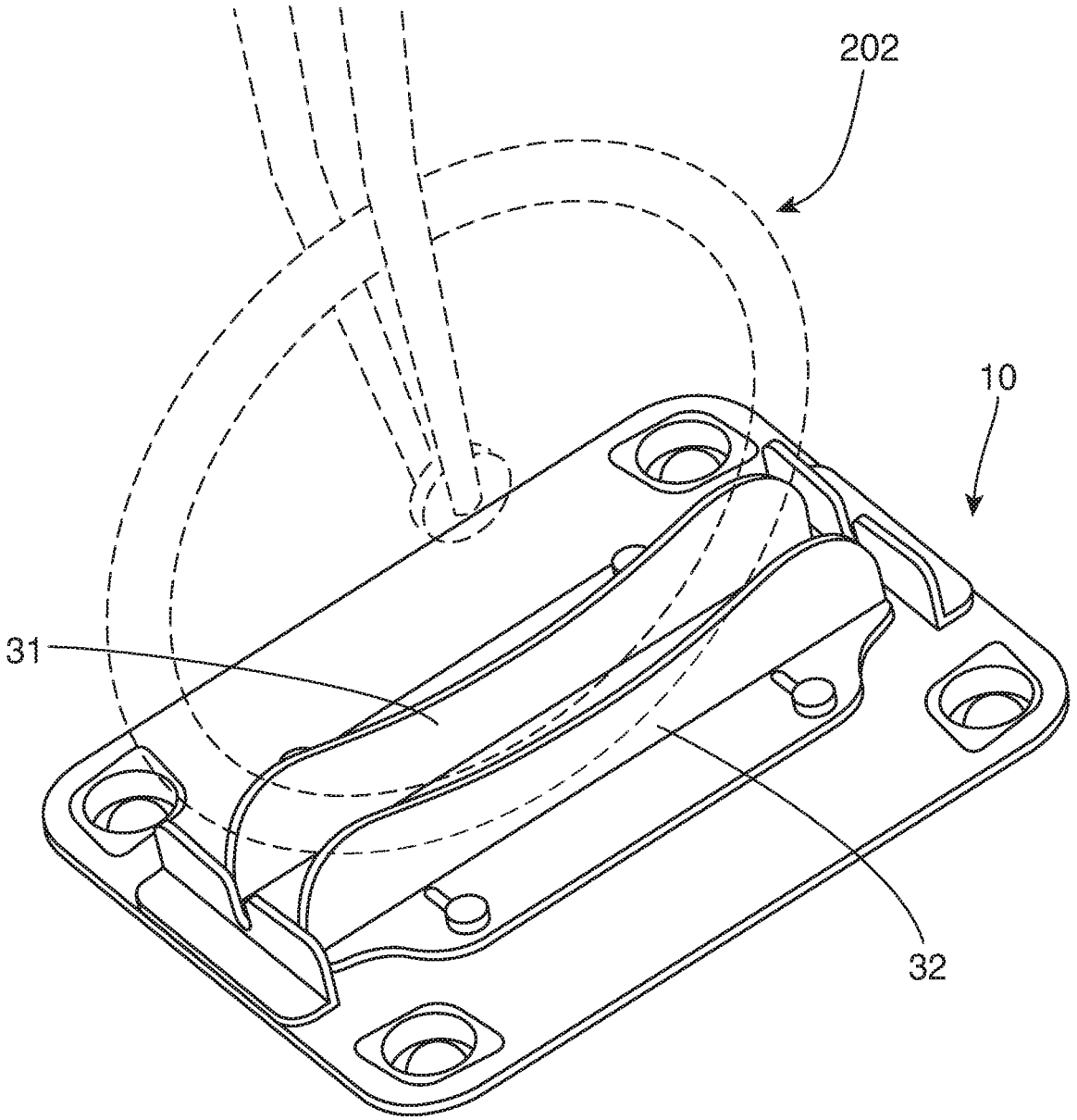
FIG. 2B is a close up view of the front wheel of a bicycle being supported by the steering assembly as disclosed in accordance with at least one embodiment of the present invention.

As shown in the accompanying drawings, and with reference briefly to FIGS. 1A, 1B, and 1C at least one embodiment of the present invention is generally directed to a steering base or steering assembly, represented as 10. As described herein, the steering base 10 of at least one embodiment is structured and configured to move omnidirectionally upon a ground surface while simultaneously supporting a front end mounting device 100, including, but in no way limited to an elevator or other gradient adjustment device, as described herein. Furthermore, in some embodiments, as illustrated in FIGS. 2A and 2B, the steering assembly or. steering base 10 can support or receive the front wheel or tire 202 of a bicycle 200, as disclosed herein.

Figure 3A:
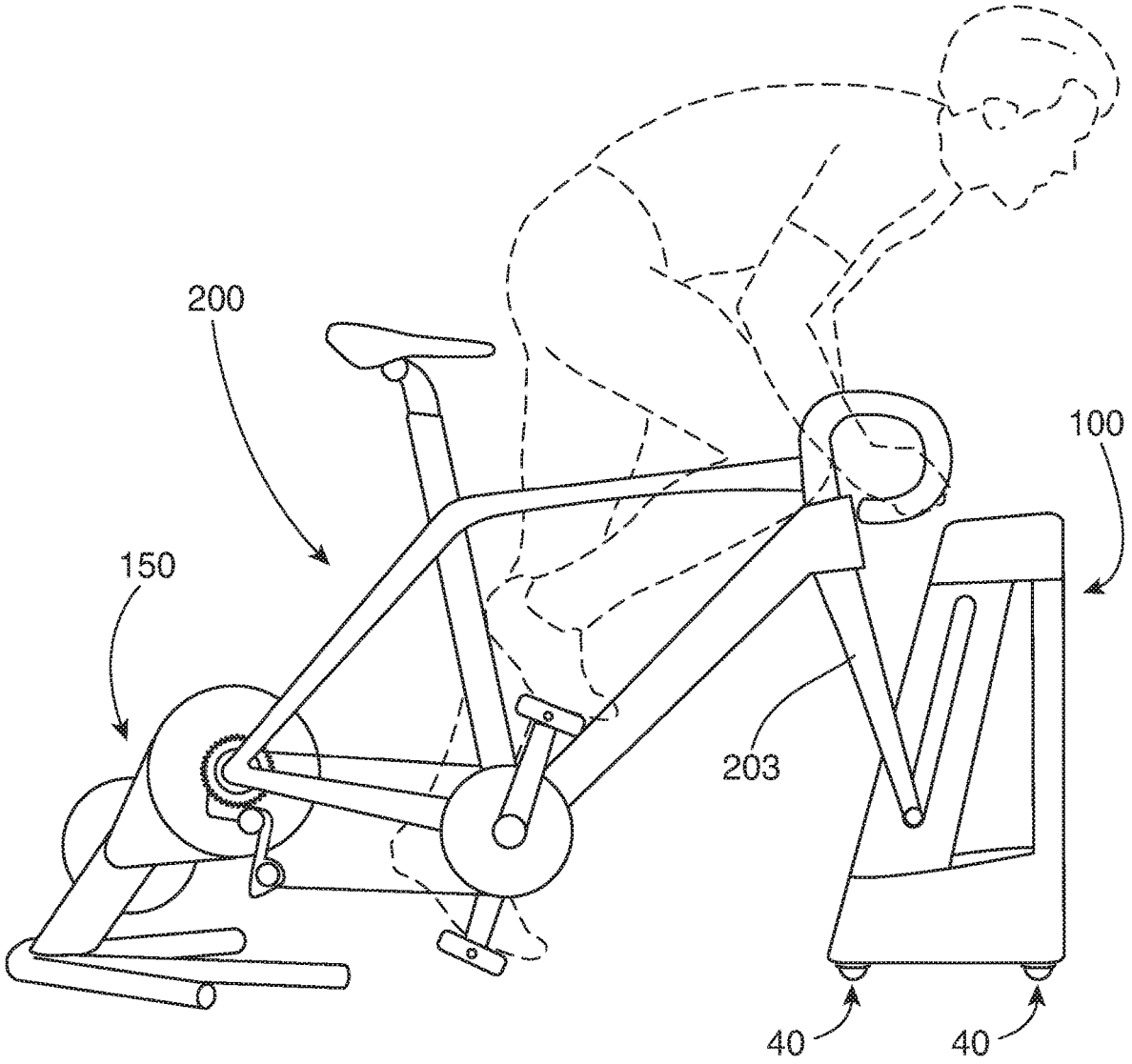
FIG. 3A is an exemplary illustration of a bicycle mounted to a gradient adjustment device with an integrated base and omnidirectional rollers, as disclosed in accordance with at least one embodiment of the present invention.
Figure 3B:
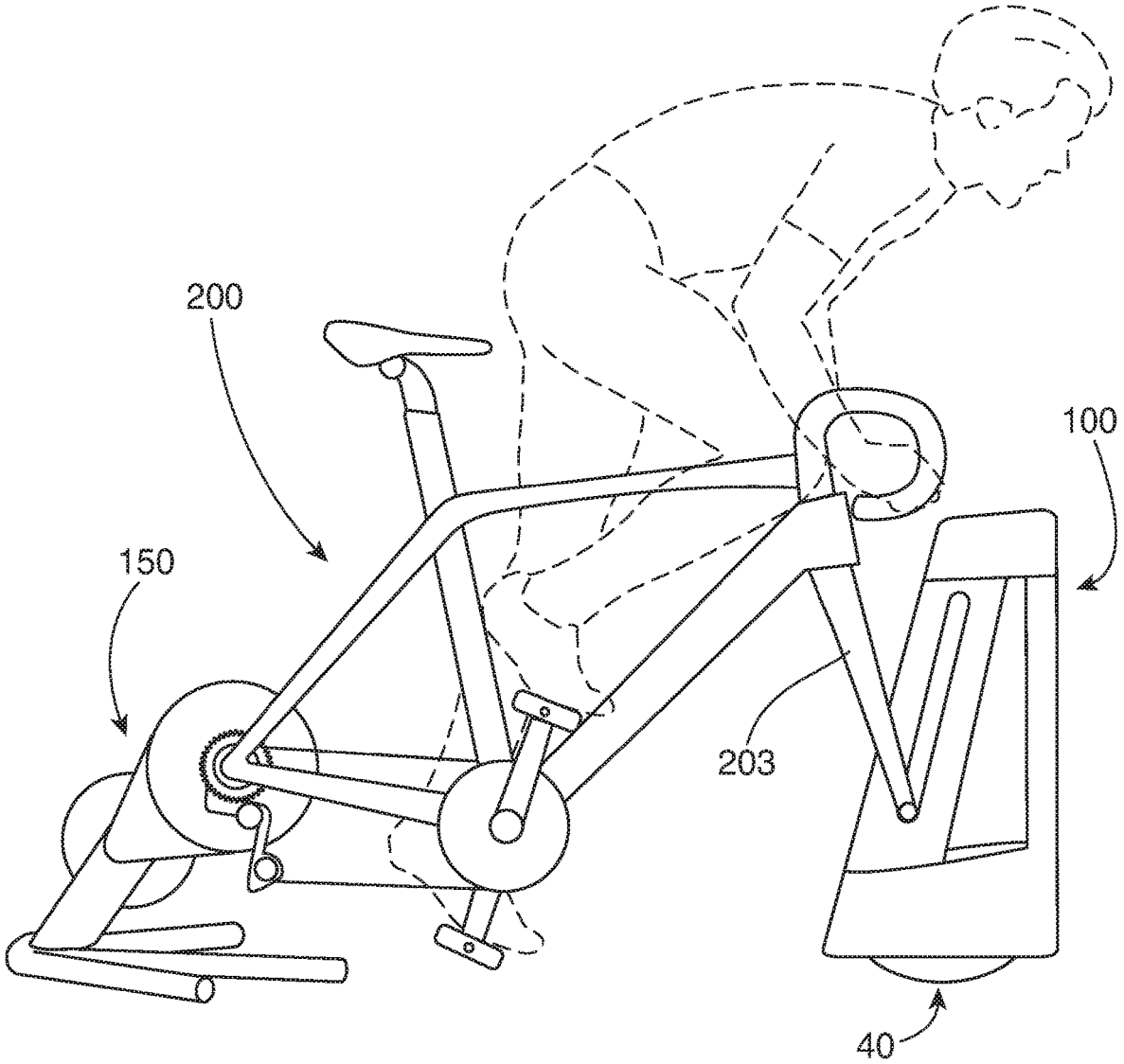
FIG. 3B is an exemplary illustration of a bicycle mounted to a gradient adjustment device win an integrated base and a single omnidirectional roller, as disclosed in accordance with at least one embodiment of the present invention.

Additionally, while the embodiments shown in FIGS. 1A through 2B illustrate a separate or stand-alone base 10 upon which the front end mounting device 100 or front wheel or tire 202 is seated or supported, in other embodiments, as illustrated in FIGS. 3A and 3B, for example, the base 10 may be integral with or other built into the front end mounting device 100. In this case, the bottom or base of the front end mounting device 100 may include one or more omnidirectional integral roller assemblies 40 extending therefrom and in contact with the ground or other support. surface. Referring to FIG. 3A, although the side view shows two roller assemblies, there may be four roller assemblies (e.g., one roller assembly proximate each corner) or more. Other embodiments, whether integral with the front end mounting device 100 or a separate stand-alone base 10, may include any number of roller assemblies 40, including a single roller assembly 40 as shown, for example, in FIG. 3B, two, three, four, or more roller assemblies 40.

Moreover, with reference to FIGS. 1A, 1B, 3A and 3B, an ordinary and operable bicycle 200 may be mounted to a front end mounting device 100 in a number of different manners, depending on the device and in some cases depending on the bicycle itself. In the illustrated embodiment, the front wheel of the bicycle 200 has been removed, and the front forks of the bicycle 203 are mounted to the device 100. The front end mounting device 100 illustrated in FIGS. 1A, 1B, 3A, and 3B is referred to herein as an elevator or a gradient adjustment device which, as described herein, may be structured to raise and lower the front end of the bicycle 200 using internal mechanics, gears or systems, for example.

Also, in the example illustrated, the rear wheel of the bicycle 200 has been removed and the bicycle 20 is mounted to a rear stand or trainer 150. The front end mounting device 100 and/or the trainer 150 may be operational with and communicative with a virtual reality cycling game or system, including but not limited to ZWIFT®, as described herein. It should be noted however, that the front end mounting device 100, trainer 150, and bicycle 200 illustrated in the Figures are for exemplary purposes only and should not be deemed limiting in any fashion. In other words, other front end mounting devices, trainers, stands, rocker plates, etc. can be used in connection with the various embodiments of the present invention described herein.

Figure 4A:
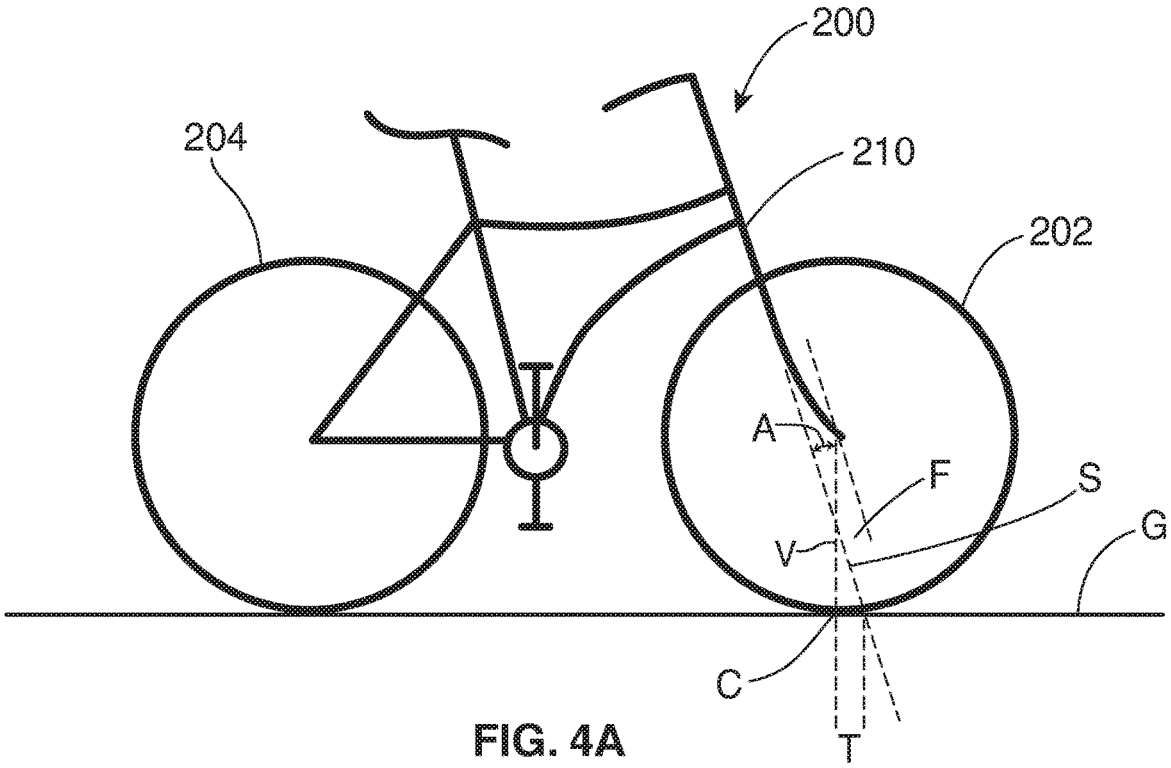
FIG. 4A is a schematic representation illustrating the trail of an exemplary bicycle disposed in a first position.

In any event, as mentioned above, virtually all steered vehicles or devices, such a bicycles, have some form of self-aligning and stabilizing geometry to the steering system known as "trail." As shown in FIG. 4A, trail, referenced as T, is defined as the horizontal distance the contact patch C of a steered wheel falls behind (or in some cases in front of) an imaginary line drawn through the steering axis S to the ground G. The contact patch C is the point at which the front wheel or tire 202 contacts the ground G. In other words, trail T is defined as the distance where the steered wheel 202 (e.g., the front wheel on a bicycle 200) touches the ground G (e.g., at contact patch C) to where the steering axis S intersects the ground G. The steering axis S is a straight-lined axis drawn through the steering tube 210 of the bicycle 200 to intersect the ground G.

A head angle or head tube angle A can be defined as the angle between steering axis S and a vertical axis V extending vertically from the contact patch C of the wheel on the ground G. It should be noted that the trail T of a standard bicycle with both wheels or tires on the ground can be increased by increasing the size of the wheel or tire 202, increasing the head angle A, or decreasing the fork offset F. Similarly, trail T of a standard bicycle with both wheels on the ground can be decreased by decreasing the head angle A, increasing the fork offset F, or decreasing the diameter of the wheel or tire 202.

Figure 4B:
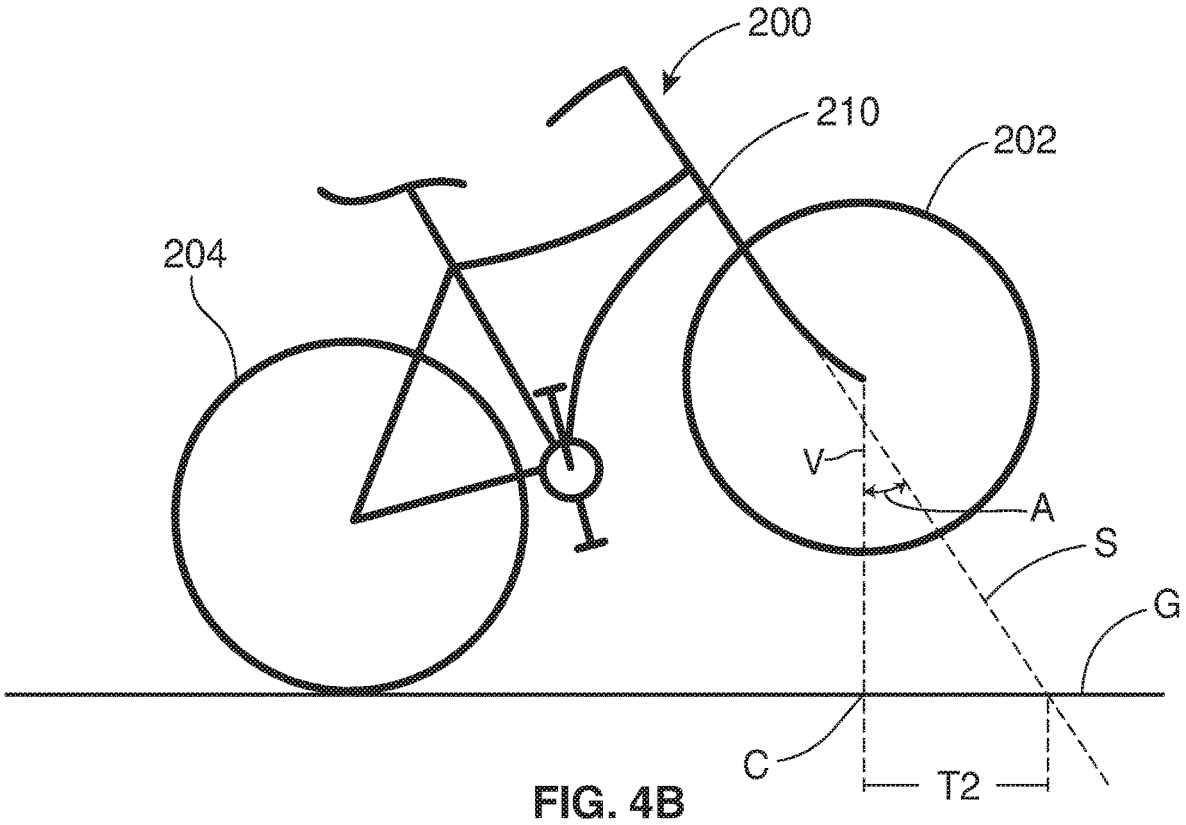
FIG. 4B is a schematic representation illustrating the trail of the same exemplary bicycle disposed in a second position.

Still referring to FIG. 4A, the bicycle 200 is shown disposed in its normal operating orientation, for example, with the front wheel or tire 202 and rear wheel or tire 204 on the ground G. FIG. 4B is presented as a simulation or schematic to illustrate what happens to the trail T2 when the front end of a bicycle is raised, while the rear end remains in place or substantially in place—as would be the case if the bicycle were secured to an elevator or other gradient adjustment device, as represented in FIGS. 1A and 1B. For example, as shown in FIG. 4B, with the front end of the bicycle raised, the trail T2, is increased relative to T shown in FIG. 4A. As described above, when the front end of the bicycle 200 is raised relative to the ground G, for example, by an elevator or other gradient adjustment device (as shown at 100 in FIG. 1B) the trail T2 is dramatically increased. Similarly, when the front end of the bicycle 200 is lowered, for example, by an elevator or other gradient adjustment device, the trail is dramatically decreased.

With reference to FIGS. 1A and 1B, as the elevator raises and lowers the front end of the bicycle 200, the base 10 of the present invention may need to move forward and backward to accommodate the change or movement. In addition, and perhaps more importantly, during operation of the bicycle 200, the front end mounting device 100 and base 10, turning or rotation of the handle bars left and/or right while the front end mounting device 100 is in a lower position (e.g., as shown in FIG. 1A) will define a much different path along the ground than when the device 100 is in a higher position (e.g., as shown in FIG. 1B). The different arcuate and linear paths of travel are exemplified in FIGS. 5A, 5B, 5C and 5D.

More in particular, FIGS. 5A through 5D illustrate exemplary movements of the base 10 (not shown in FIGS. 5A-5D) along various arcuate and linear paths. For example, with reference to the schematic of FIG. 5A, steering axis S is shown along with a plurality of arcuate paths A1, A2, A3, A4. The arcuate paths A1-A4 are represented as being paths along the ground which the base may travel (e.g., if you were to follow the center of the base along the ground) as the rider steers the handlebars left and right. More in particular, A1 represents an arcuate path relative to the steering axis S when the elevator device 100 (shown in FIGS. 1A-1B, for example) positions the front of the bicycle below its normal level orientation (e.g., at a gradient of −10%). In this orientation, the base will travel along the ground in an arcuate path A1 having a small radius when the handlebars are turned left and right. Furthermore, A2 represents an arcuate path relative to the steering axis S when the elevator device 100 positions the bicycle at its normal level orientation (e.g., as if the wheels were on the bicycle and the bicycle was resting on the ground in the upright riding position). In this manner, the base will travel along the ground in an arcuate path A2 having a larger radius than A1.

As the front end of the bicycle is raised, for example, via the elevator, the base will travel along the ground when the handlebars are turned left and right in arcuate paths A3 (e.g., when front end of the bicycle is raised to a gradient of +10%) and A4 (e.g., when the front end of the bicycle is raised to a gradient of +20%) with increasing radii.

Figure 5A:
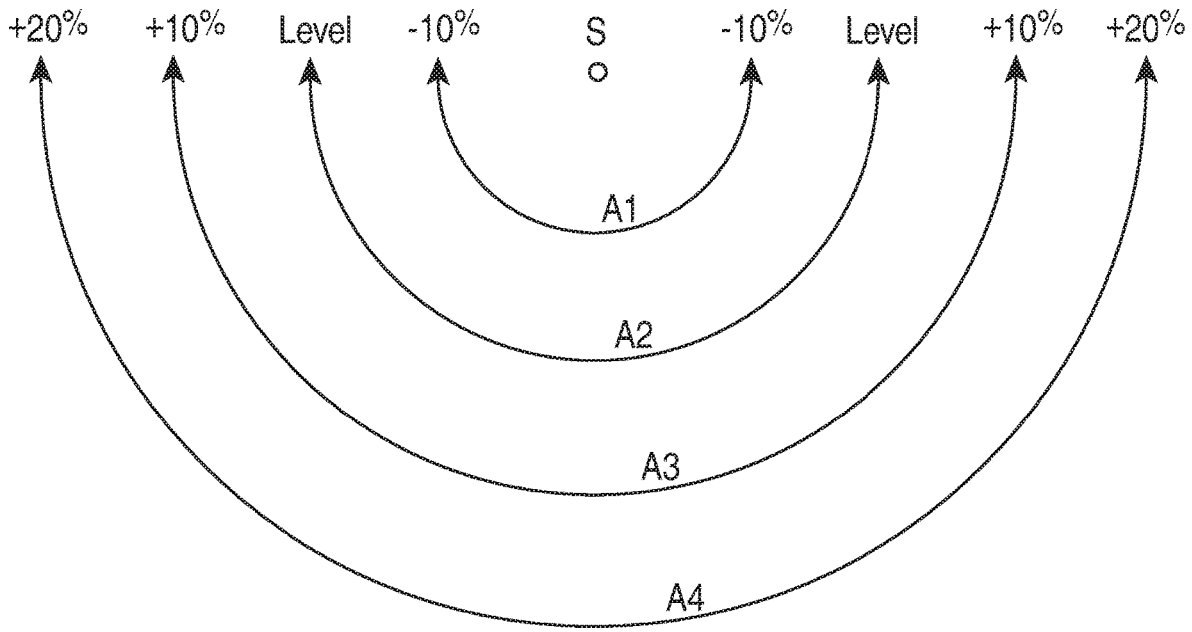
FIG. 5A is a schematic representation illustrating a plurality of four different arcuate paths of the steering assembly of at least one embodiment of the present invention, each of which represent a different gradient position and therefore a different trail.

It should also be noted that the arcuate paths A1-A4 illustrated in FIG. 5A and the different gradients (−10% to +20%) are merely exemplary and representative of the different arcuate paths with which the base may travel as the front end of the bicycle changes heights during operation.

Figure 5B:
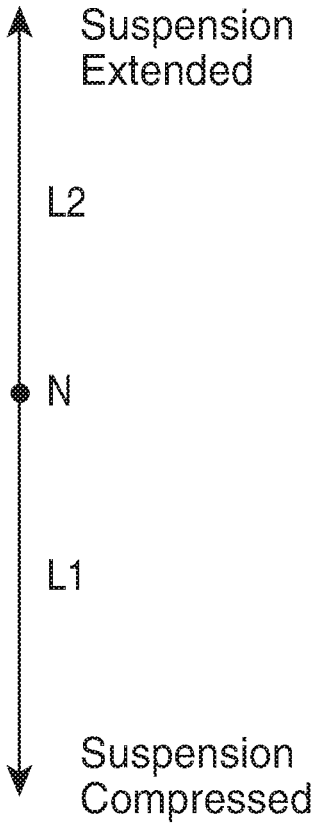
FIG. 5B is a schematic representation illustrating linear paths of the steering assembly of at least one embodiment of the present invention as the suspension of the bicycle is compressed or extended.

Referring now to FIG. 5B, a schematic is shown to illustrate that as the suspension of the bicycle changes (e.g., being compressed, neutral or extended) the base will travel in linear paths L1, L2. More in particular, N represents the position of the base when the suspension of the bicycle is neutral or otherwise not compressed or extended. If the suspension of the bicycle is compressed, the base will travel backward, for example along linear path L1. Similarly, if the suspension of the bicycle is extended, the base will travel forward, for example along linear path L2.

Figure 5C:
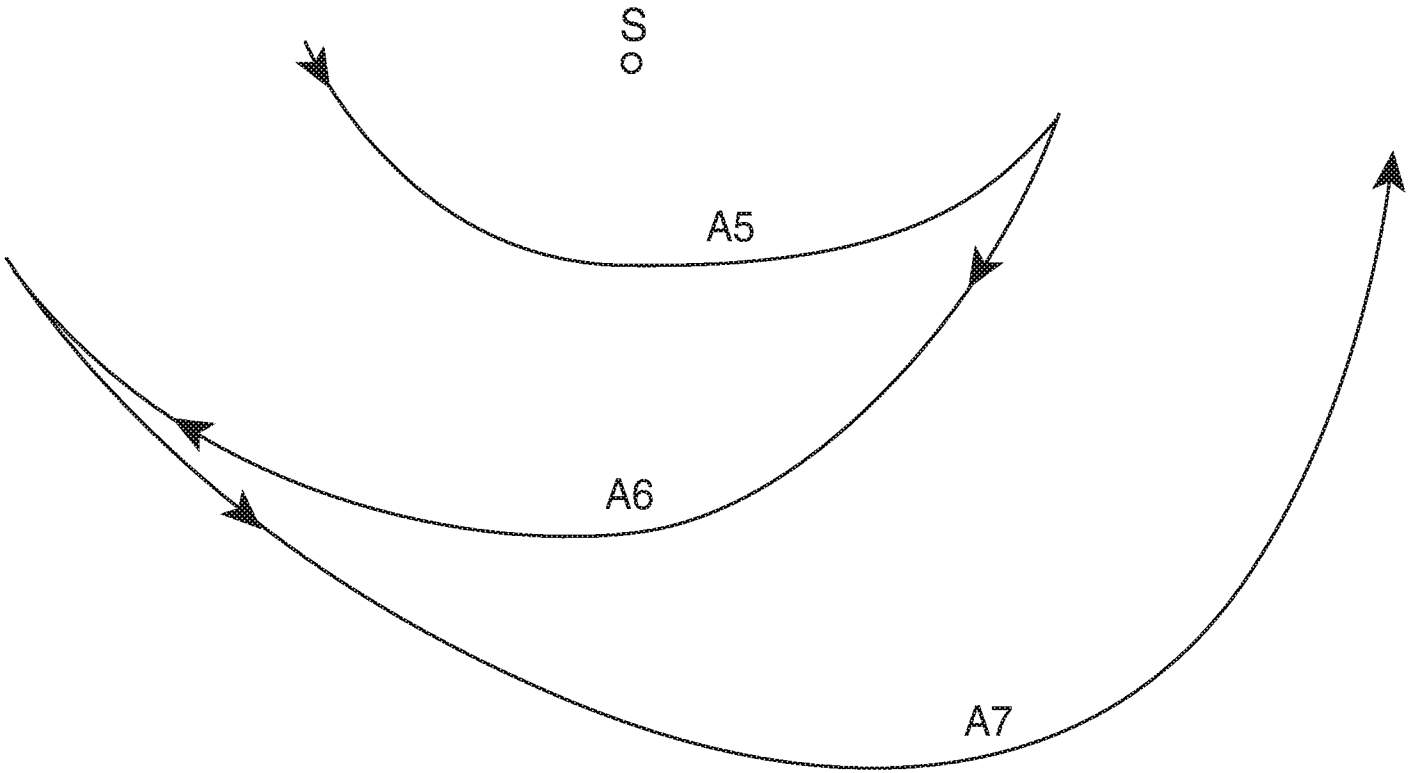
FIG. 5C is a schematic representation illustrating a plurality of complex arcuate paths of the steering assembly of at least one embodiment of the present invention with the gradient or trail being increased while the rider simultaneously turns the bicycle left and right.

The path of the base along the ground becomes even more complex when the rider turns the handlebars left or right while the front end of the bicycle simultaneously changes heights, e.g., whether due to an increasing or decreasing gradient from the elevator device or due to a change in the state of the suspension of the bicycle. FIG. 5C illustrates exemplary arcuate paths A5, A6 and A7 that the base may travel if the rider turns the handlebars of the bicycle left and right while the gradient of the bicycle is simultaneously increased. As shown, the arcuate paths A5, A6 and A7 do not form symmetrical or paths along the ground.

Figure 5D:
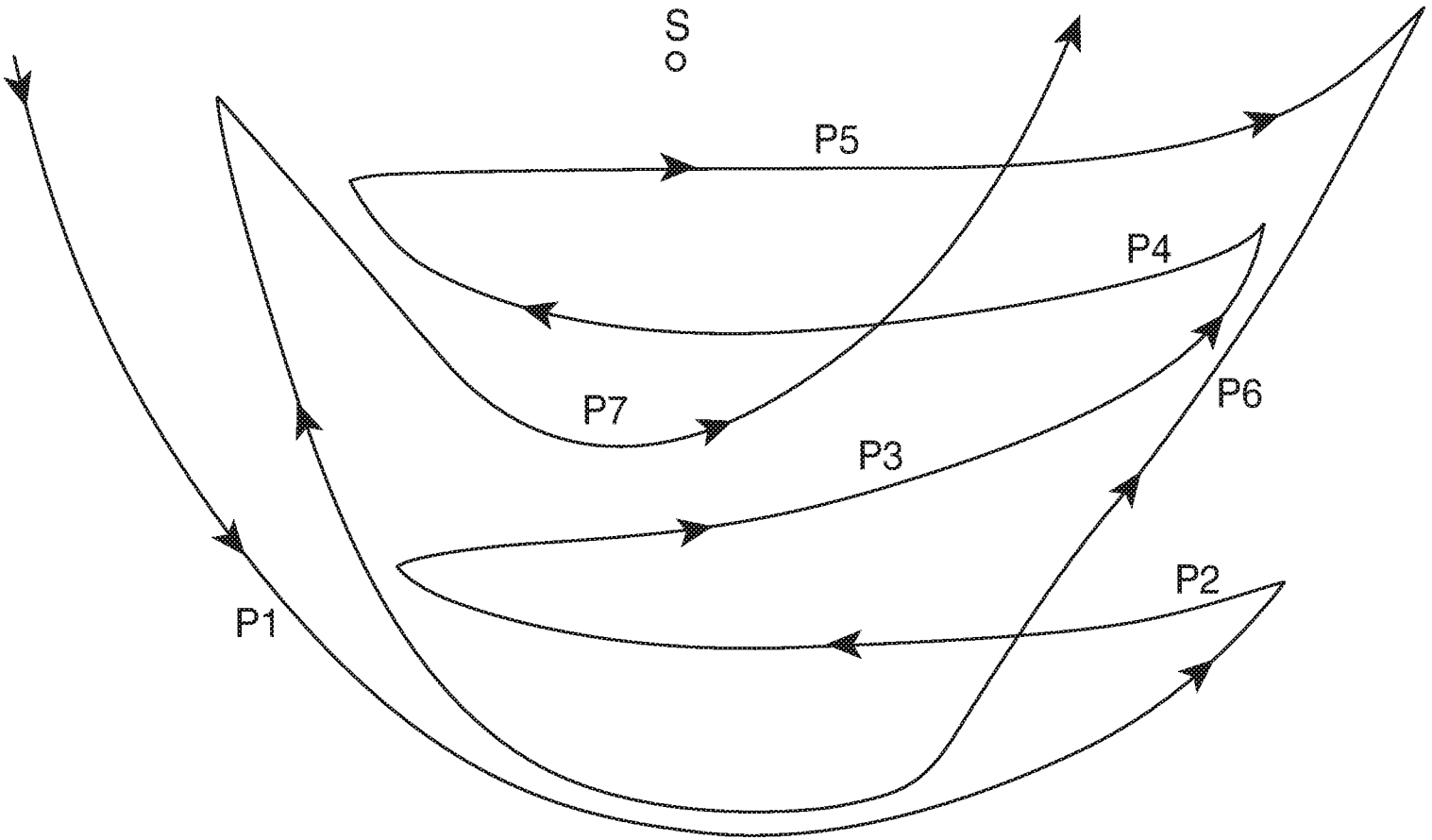
FIG. 5D is a schematic representation illustrating a plurality of complex arcuate paths of the steering assembly of at least one embodiment of the present invention with the gradient or trail being increased and decreased while the rider simultaneously turns the bicycle left and right.
Figure 6:
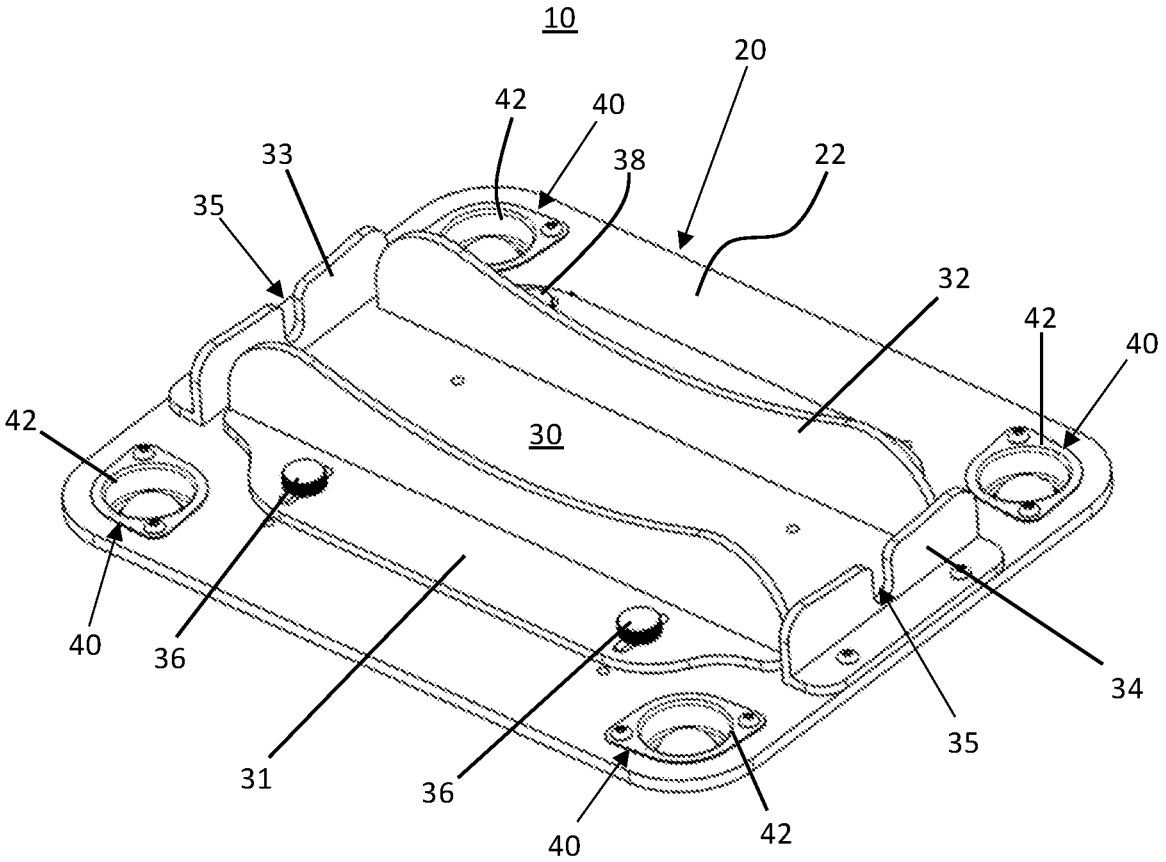
FIG. 6 is a top perspective view of the steering assembly as disclosed in accordance with at least one embodiment of the present invention.
Figure 7:
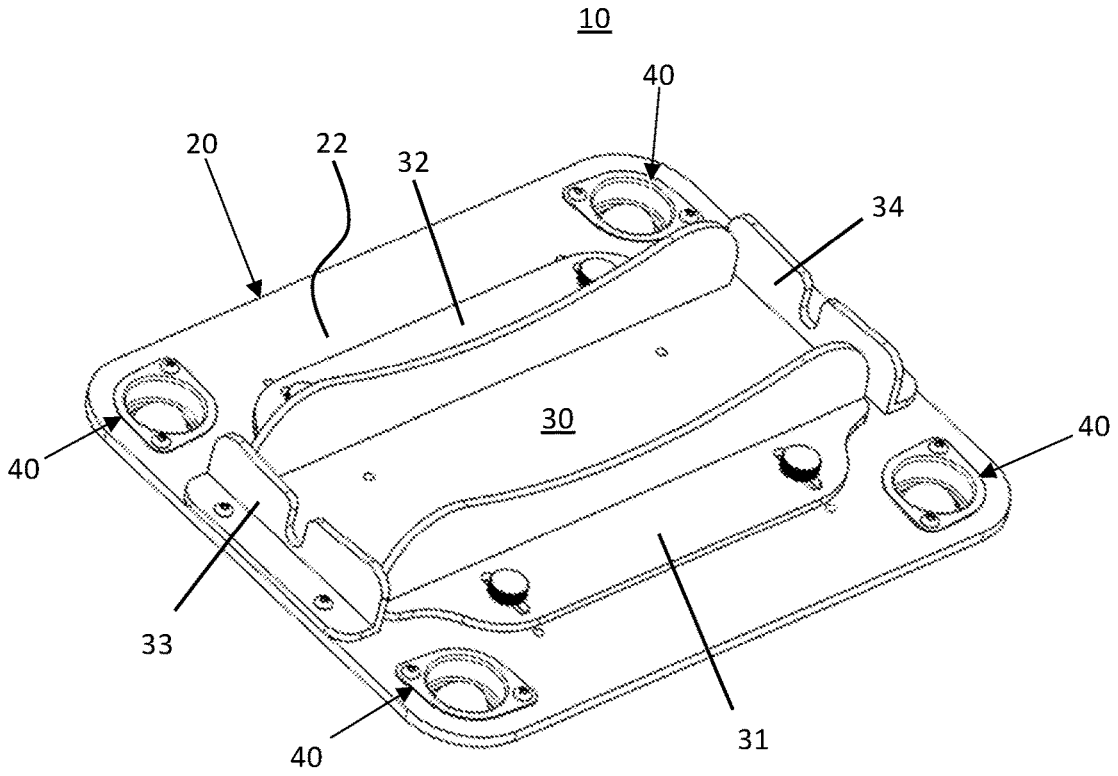
FIG. 7 is another top perspective view of the steering assembly as disclosed in accordance with at least one embodiment of the present invention.
Figure 8:
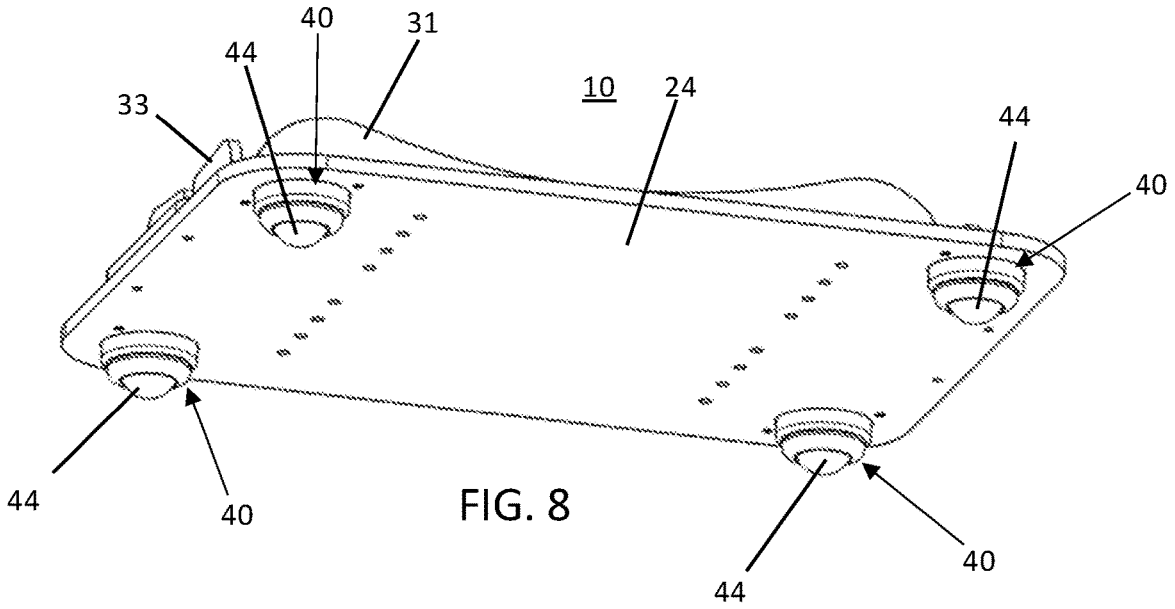
FIG. 8 is a bottom perspective view of the steering assembly as disclosed in accordance with at least one embodiment of the present invention.
Figure 9:
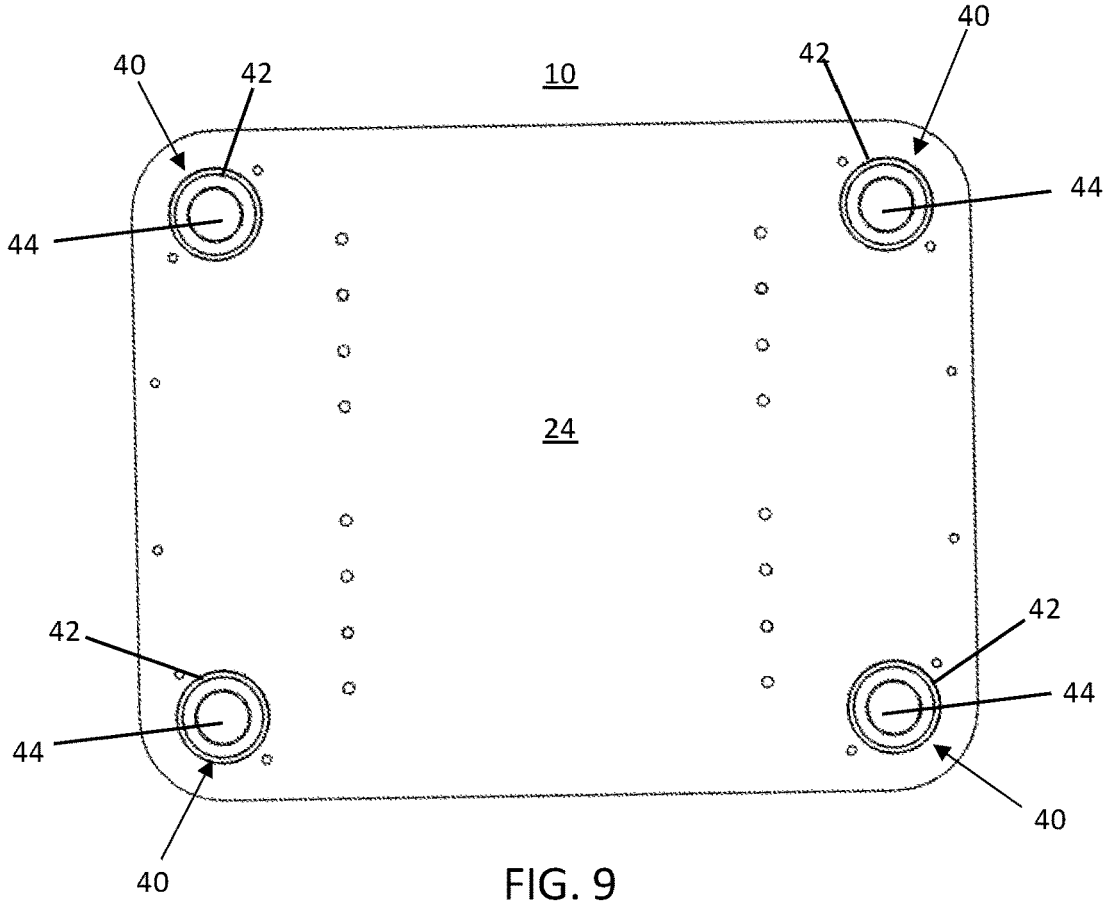
FIG. 9 is a bottom view of the steering assembly as disclosed in accordance with at least one embodiment of the present invention.
Figure 10:
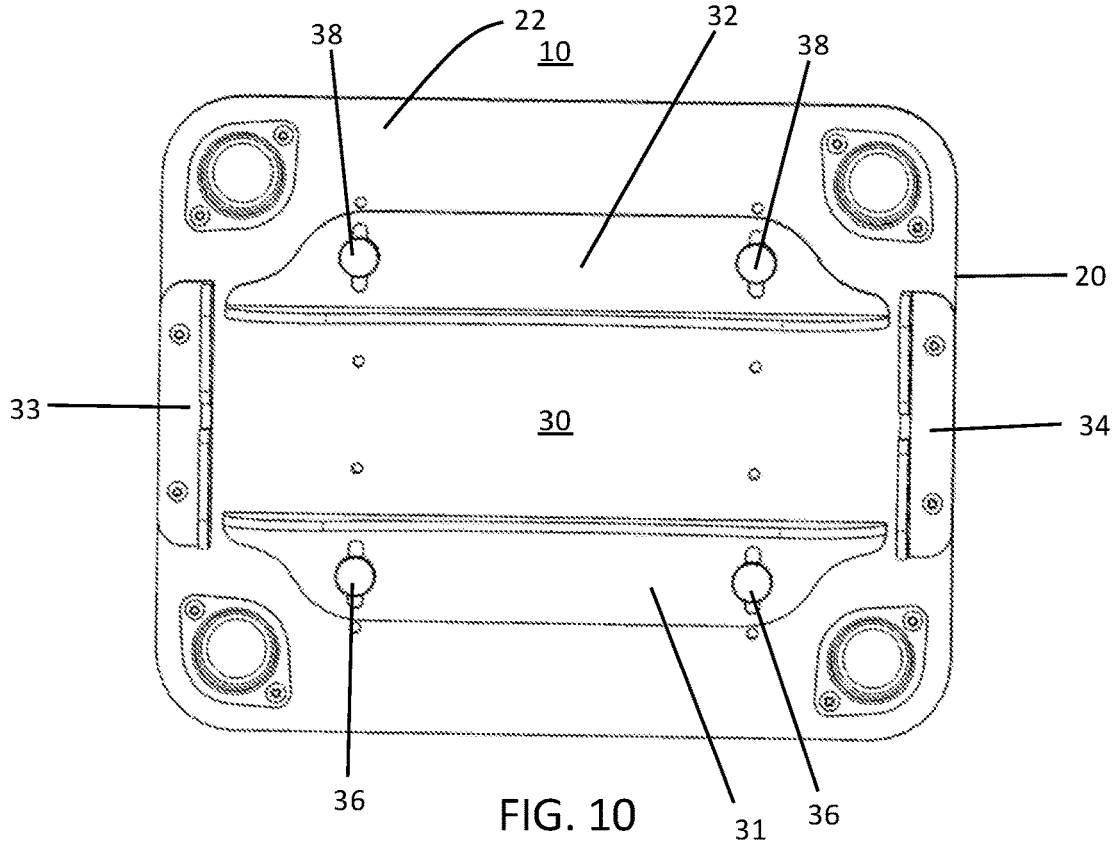
FIG. 10 is a top view of the steering assembly as disclosed in accordance with at least one embodiment of the present invention.
Figure 11:
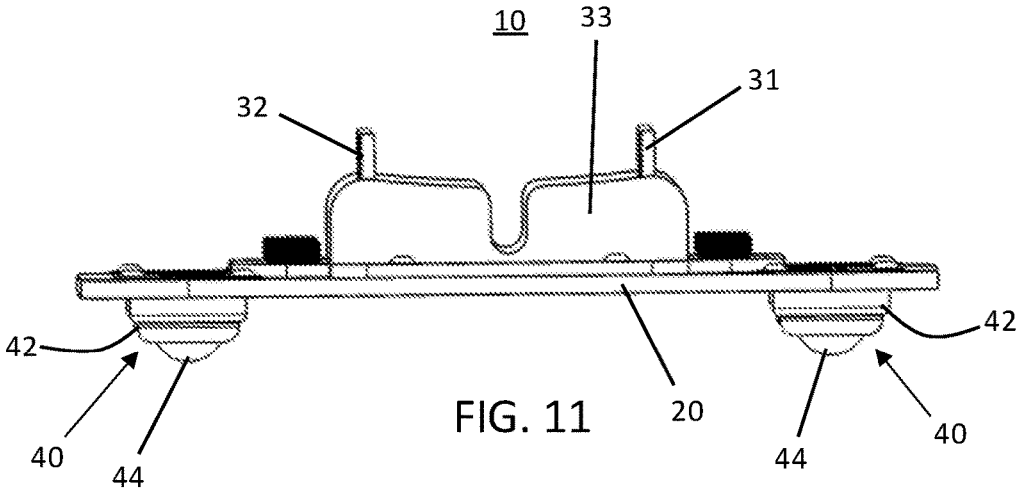
FIG. 11 is an end view of the steering assembly as disclosed in accordance with at least one embodiment of the present invention.
Figure 12:
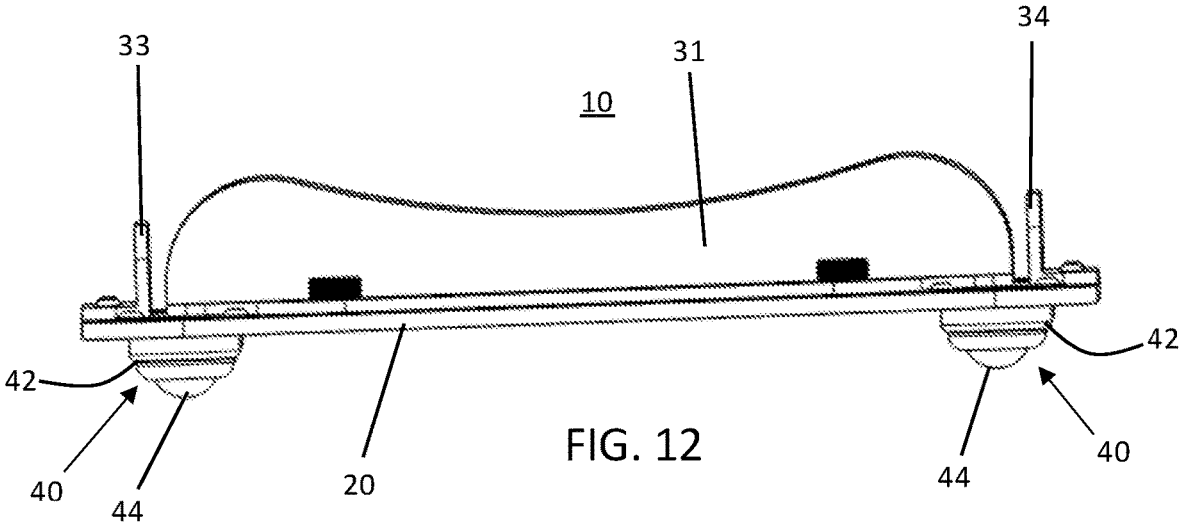
FIG. 12 is a side view of the steering assembly as disclosed in accordance with at least one embodiment of the present invention.

Similarly, FIG. 5D illustrates a plurality of complex paths P1 through P7 along the ground which the base may follow as the front of the bicycle (e.g. gradient) is increased and decreased while the rider simultaneously turns left and right. For instance, as the gradient of the bicycle is raised and lowered, the trail of the bicycle will change, causing the complex arcuate and sometimes linear paths which the base may follow. This is why the roller assembly of at least one embodiment of the present invention is omnidirectional—allowing the base to travel along the ground or other surface in these complex paths during operation of the bicycle, elevator, or other training assembly, as described herein.

With reference now to FIGS. 6 through 12, at least one embodiment of the steering base 10 of the present invention is illustrated. In particular, the base 10 may include a support platform 20 defining a top surface 22 and a bottom surface 24. As described herein, and as exemplified in FIGS. 3A and 3B, the base 10 or platform 20 of at least one embodiment may be integrated with or part of the bottom surface of a front end mounting device 100, including but not limited to an elevator or other gradient adjustment device. In other embodiments, as shown in FIGS. 1A through 2B, the base 10 or platform 20 may be a separate device upon which the front end mounting device 100 or bicycle 200 is supported or mounted.

Furthermore, and still referring to FIGS. 6 through 12, the present invention includes one or more roller assemblies, generally referenced as 40. The roller assemblies 40 may extend from or beyond the bottom surface 24 of the platform 20 or base such that the roller assemblies 40 will directly engage or contact the ground surface or other support surface during operation. In particular, with the bottom surface 24 of the platform 20 or base facing the ground surface, and the bicycle 200 or front end mounting device 100 disposed in a supporting relation thereon, the roller assemblies 40 will contact or engage the ground surface in a manner to allow the platform 20 or base to freely roll or move thereon in a plurality of different arcuate and linear paths. Accordingly, in at least one embodiment, the roller assemblies 40 may be able to move or roll in all directions—forward, backward, side to side—in arcuate, circular and linear patterns or paths, and thus, in some embodiments, the roller assemblies are referred to herein as omnidirectional.

More in particular, in the embodiment illustrated, the base or platform 20 includes one or more omnidirectional roller assemblies 40 disposed in a manner to sufficiently support the platform 20 during use. For example, a single roller assembly may extend from the bottom of the platform, such as at or near the center thereof, in a manner sufficient to support the platform 20 consistent with the intended operation of the present invention. In other embodiments, a different one of a plurality of omnidirectional roller assemblies 40 is disposed at or near a corner of the platform 20, although other locations, patterns and placements of the rollers assemblies 40 is contemplated within the full spirit and scope of the present invention.

Furthermore, the one or more omnidirectional roller assemblies 40 are structured and configured to facilitate movement of the base 10 and support platform 20 along the ground surface in a manner to accommodate varying trail measurements of the bicycle during operative use of the base 10. For example, as described above, when the base 10 is used in connection with an elevator or gradient adjustment device, which raises and lowers the front end of the bicycle, the trail varies during operative use of the base 10. More particularly, when the elevator or gradient adjustment device raises the front end of the bicycle (e.g., as shown in FIG. 1B) to simulate a raised slope, the trail T, T2 of the bicycle increases, which changes the arcuate path of which the base 10 will move as the user or rider turns the front handlebars or steering column. Similarly, when the elevator or gradient adjustment device lowers the front end of the bicycle (e.g., as shown in FIG. 1A) to simulate a decreased slope, the trail T of the bicycle decreases, which again changes the arcuate path of which the base 10 will move as the user or rider turns the front handlebars or steering column. For instance, the larger the trail, the larger or wider of an arc is created by the path of the base 10.

In this manner, as the base 10 is used, it must and does accommodate varying (e.g., increasing and decreasing) trail measurements during the same simulated ride. In other words, the one or more omnidirectional roller assemblies 40 of at least one embodiment of the present invention are structured to facilitate movement of the support platform along the ground surface or other support surface in a first arcuate path (e.g., as shown at A2 in FIG. 5A) while the bicycle defines a first trail T. During the same simulated ride, the omnidirectional roller assemblies 40 are also structured to facilitate movement of the support platform 20 along the ground surface or other support surface in a second or more arcuate path(s) (e.g., as shown at A1, A3 and A4 in FIG. 5A). More in particular, each of the different paths A1, A2, A3 and A4 represent the bicycle with the front end disposed at different heights, and therefore, defining different trails. FIGS. 5C and 5D represent paths which are created by the base as the height of the front end of the bicycle is changed while the rider simultaneously rotates or moves the handlebars left and/or right.

It should also be noted that during operation, the base 10 or platform 20 is able to move in linear directions, including but not limited to side-to-side and/or forward-and-backward movements, via the plurality of omnidirectional roller assemblies 40.

Accordingly, in at least one embodiment, the one or more omnidirectional roller assemblies 40 may be in the form of ball transfer units defined as including a support fixture 42 within which an omnidirectional roller ball or bearing 44 is disposed. The ball or bearing 44 is able to move in all directions, and is thus considered omnidirectional. One example of an omnidirectional roller assembly 40 is a steel transfer ball bearing, although others are contemplated within the full spirit and scope of the present invention.

For instance, the support fixture 42 may be mounted to the platform 20 in a manner such that the roller or ball 44 extends down beyond bottom surface 24. As mentioned above, the platform 20 or base 10 may be integral with the front end mounting device 100, and thus, in some embodiments, the roller assemblies 40 may be mounted to the bottom surface of the front end mounting device, or otherwise mounted directly to the front end mounting device in a manner to support the front end mounting device on the ground surface and operate in the intended fashion, as described herein. It should also be noted that in some cases, the roller assemblies 40 may be adjusted in order to adjust the height of the platform 20 from the ground.

Still referring to FIGS. 6 through 12, at least one embodiment of the present invention also includes a shoe, referenced as 30 disposed on and extending from the top surface 22 of the platform 20. In particular, the shoe 30 of at least one embodiment is structured to receive and, in some cases, at least partially support the bottom surface of the front end mounting device 100 or elevator device, as exemplified in FIGS. 1A, 1B and 1C. In some embodiments, the shoe 30 may include one or more adjustable side walls 31, 32 which can slide inward (toward each other) and outward (away from each other) to decrease and increase the distance between them, respectively. In this manner, the shoe 30 may accommodate different front end mounting devices 100 which may have different widths or different footprint dimensions.

Furthermore, the adjustable side walls 31, 32 may slide or adjust close to each other in order to receive and accommodate the front wheel or tire 202 of a bicycle, as exemplified in FIGS. 2A and 2B.

Yet another embodiment of the present invention may include a non-adjustable shoe secured to the platform 20 and which includes a receiving area dimensioned to receive and support a specific tire size or a range of tire sizes, such as the tires on a road bicycle or mountain bicycle, or a front end mounting device having a particular footprint dimension or range. In other words, the shoe of at least one embodiment can be fixed or non-adjustable to either receive a front end mounting device or tire that fits therein.

In any manner, with reference to FIGS. 6 through 21, it should be noted that the shoe 30 of at least one embodiment may include one or a plurality of stops or walls, referenced as 31, 32, 33, 34 which extend up from the top surface 22 of the platform 20 and which will at least partially surround a lower surface of the front end mounting device 100 or bicycle wheel or tire.

As illustrated in FIG. 1C, for example, in some cases, a space is left between the surface of the front end mounting device 100 and the walls or stops 31, 32, 33, 34 in order to allow the front end mounting device 100 to shift or move forward, backward, and side-to-side within the shoe 30 during use. In other words, the walls or stops 31, 32, 33, 34 may not in some cases, contact or engage the surfaces of the front end mounting device 100 during use. In other cases, one or more of the walls or stops 31, 32, 33, 34 may engage or contact the surface(s) of the front end mounting device 100 during use.

It should also be noted, as described herein, that in other embodiments, the shoe 30 may be configured to receive and at least partially support the front wheel 202 of the bicycle 200, such that it may directly engage or mount to the base 10.

Additionally, grooves or recesses 35 may be disposed on opposing end stops 33, 34 and configured to receive the power cable or other cables or cords from the front end mounting device, including, for example, an elevator or other gradient adjustment device.

Furthermore, the shoe 30 of at least one embodiment is adjustable in at least one direction. In particular, in at least one embodiment, the shoe 30 may be defined as including two end stops, such as a front stop 33 and a rear stop 34, and two side or lateral stops 31, 32. In one embodiment, at least one of the stops 31, 32, 33, 34 may be adjustable in that it may move toward and away from the center of the platform 20 in order to adjust the internal dimension of the shoe 30.

In the embodiment illustrated, the two side or lateral stops or walls 31, 32 are slidingly adjustable toward and away from each other or otherwise toward and away from the center of the platform 20, while the two end stops or walls 33, 34 are fixed. As just an example, knobs 36, 38 may be loosened to allow the corresponding wall or stop 31, 32 to be adjusted. Tightening the knob(s) 36, 38 will again secure the corresponding wall or stop 31, 32 in place. In other words, knobs 36, 38 may include a threaded rod that extends through a corresponding elongated slot and secures into the platform. Loosening of the knob(s) 36, 38 allows the threaded rod to slide within the elongated slot, which in turn, allows the corresponding wall of the shoe to be adjusted or repositioned.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A steering assembly for a mounted bicycle, comprising:

a support platform defining a top surface and a bottom surface, said top surface being opposite said bottom surface, a shoe disposed on said top surface, wherein said shoe is adjustable in at least one direction, and at least one omnidirectional roller assembly extending from said bottom surface of said support platform, said at least one omnidirectional roller assembly being operatively disposed upon a ground surface and being structured to facilitate movement of said support platform along the ground surface in a plurality of different arcuate and linear paths.

2. The steering assembly as recited in claim 1 wherein said shoe is structured to receive and at least partially support a bottom surface of a front end mounting device, the front end mounting device being capable of securely mounting at least a front portion of a bicycle.

3. The steering assembly as recited in claim 1 wherein said shoe is structured to receive a front wheel of a bicycle.

4. The steering assembly as recited in claim 1 wherein said shoe comprises at least a front stop and a rear stop.

5. The steering assembly as recited in claim 4 wherein said front stop and said rear stop are fixedly secured to and extending from said top surface of said support platform.

6. The steering assembly as recited in claim 1 wherein said shoe comprises at least a left side stop and a right side stop.

7. The steering assembly as recited in claim 6 wherein at least one of said left side stop and said right side stop is laterally adjustable relative to said support platform to adjust a distance between said left side stop and said right side stop.

8. The steering assembly as recited in claim 7 wherein said left side stop and said right side stop are both laterally adjustable relative to said support platform to adjust the distance between said left side stop and said right side stop.

9. The steering assembly as recited in claim 1 wherein said at least one omnidirectional roller assembly comprises a ball transfer unit comprising an omnidirectional load-bearing roller mounted at least partially inside of and extending out from a support fixture.

10. The steering assembly as recited in claim 1 wherein said at least one omnidirectional roller assembly comprises a plurality of omnidirectional roller assemblies, each extending from said bottom surface of said support platform and disposable in direct contact with the ground surface.

11. The steering assembly as recited in claim 10 wherein said plurality of omnidirectional roller assemblies are structured to facilitate movement of said support platform along the ground surface to accommodate varying trail measurements of a bicycle during operative use of said steering assembly.

12. The steering assembly as recited in claim 11 wherein said plurality of omnidirectional roller assemblies are structured to facilitate movement of said support platform along the ground surface in a first arcuate path while the mounted bicycle defines a first trail, and wherein said plurality of omnidirectional roller assemblies are structured to facilitate movement of said support platform along the ground surface in a second arcuate path while the mounted bicycle defines a second trail, the first trail being different than the second trail.

13. The steering assembly as recited in claim 12 wherein the first trail is defined when the mounted bicycle is disposed in a first angle with the ground surface via a front end mounting device and wherein the second trail is defined when the mounted bicycle is disposed in a second angle with the ground surface via the front end mounting device.

14. The steering assembly as recited in claim 13 wherein each of said plurality of omnidirectional roller assemblies comprises an omnidirectional load-bearing roller mounted at least partially inside of and extending out from a support fixture.

15. A steering assembly for a mounted bicycle, comprising:

a support base defining a bottom surface, said support base being structured to at least partially support a front end mounting device, the front end mounting device being structured to at least partially support a bicycle, a shoe disposed on a top surface of said support base, said shoe defining a receiving area being structured to support a bottom surface of the front end mounting device, wherein said shoe is at least partially adjustable to adjust an interior dimension defined within said receiving area, a plurality of omnidirectional roller assemblies extending from said bottom surface of said support base, said plurality of omnidirectional roller assemblies being operatively disposable in direct contact with a ground surface and being structured to facilitate movement of said support base along the ground surface in a plurality of different arcuate and linear paths to accommodate varying trail measurements of the mounted bicycle during operative use of said steering assembly, the varying trail measurements of the mounted bicycle being defined by varying angles of the mounted bicycle relative to the ground surface during operative use of said steering assembly.

16. The steering assembly as recited in claim 15 wherein each of said plurality of omnidirectional roller assemblies comprises an omnidirectional load-bearing roller mounted at least partially inside of and extending out from a support fixture.

17. The steering assembly as recited in claim 15 wherein said shoe comprises at least one adjustable stop.

18. A steering assembly for a mounted bicycle, comprising:

a support platform defining a top surface and a bottom surface, said top surface being opposite said bottom surface, a shoe disposed on said top surface, said shoe being structured to receive a front wheel of a bicycle, and at least one omnidirectional roller assembly extending from said bottom surface of said support platform, said at least one omnidirectional roller assembly being operatively disposed upon a ground surface and being structured to facilitate movement of said support platform along the ground surface in a plurality of different arcuate and linear paths.

* * * * *